US006178980B1

(12) United States Patent
Storm

(10) Patent No.: US 6,178,980 B1
(45) Date of Patent: Jan. 30, 2001

(54) METHOD FOR REDUCING THE PIPELINE DRAG OF HEAVY OIL AND COMPOSITIONS USEFUL THEREIN

(75) Inventor: David A. Storm, Montvale, NJ (US)

(73) Assignee: Texaco Inc., White Plains, NY (US)

( * ) Notice: Under 35 U.S.C. 154(b), the term of this patent shall be extended for 0 days.

(21) Appl. No.: 09/140,010

(22) Filed: Aug. 26, 1998

(51) Int. Cl.[7] ..... F17D 1/17
(52) U.S. Cl. ..... 137/13
(58) Field of Search ..... 137/13

(56) References Cited

U.S. PATENT DOCUMENTS

| | | | | |
|---|---|---|---|---|
| 3,892,252 | | 7/1975 | Poettmann | 137/13 |
| 3,950,034 | * | 4/1976 | Dreher et al. | 137/13 X |
| 4,134,415 | | 1/1979 | Flournoy et al. | 137/13 |
| 4,152,290 | | 5/1979 | Flournoy et al. | 252/355 |
| 4,190,069 | | 2/1980 | Krantz | 137/13 |
| 4,192,767 | | 3/1980 | Flournoy et al. | 252/312 |
| 4,287,902 | * | 9/1981 | McClaflin et al. | 137/13 |
| 4,289,679 | | 9/1981 | Mack | 260/33.6 PQ |
| 4,857,621 | | 8/1989 | Ball | 526/265 |
| 4,876,018 | | 10/1989 | Karydas | 252/8.551 |
| 4,993,448 | | 2/1991 | Karydas et al. | 137/13 |
| 5,021,526 | | 6/1991 | Ball | 526/240 |
| 5,263,848 | | 11/1993 | Gregoli et al. | 431/4 |
| 5,283,001 | | 2/1994 | Gregoli et al. | 252/314 |
| 5,376,697 | | 12/1994 | Johnston et al. | 523/175 |
| 5,733,953 | | 3/1998 | Faichild et al. | 523/336 |

FOREIGN PATENT DOCUMENTS

WO 95/00563 1/1995 (WO) .

OTHER PUBLICATIONS

"Flow Increase in the Trans Alaska Pipeline Using a Polymeric Drag Reducing Additive" by Edward D. Burger, Werner R. Munk, and Harry A. Wahl; Society of Petroleum Engineers, Paper SPE 9419, 55th Annual Fall Technical Conference, Dallas, TX, Sep. 21–24, 1980.

"Drag Reduction Fundamentals" by P.S. Virk; AIChE Journal, vol. 21, No. 4, pp. 625–656, Jul. 1975.

"Transportation of Heavy Crude Oil and Natural Bitumen" by D. Escojido, O. Urribarri, and J. Gonzalez; 13th World Petroleum Conference, 1991, Preprint N.14.1 8P.

"Steric Interactions in a Model Multimembrane System: A Synchrontron X–Ray Study" by C.R. Safinya, D. Roux, G.S. Smith, S.K. Sinha, P. Dimon, N.A. Clark, and A.M. Bellocq; Physical Review Letters, vol. 57, No. 21, pp. 2718–2721, Nov. 24, 1986.

"Relation Between Rheology and Microstructure of Lyotropic Lamellar Phases" by D. Roux, F. Nallet, and O. Diat; Structure and Flow in Surfactant Solutions, Ch. 21, pp. 300–305, ACS Symposium Series 578, 1994.

* cited by examiner

*Primary Examiner*—Gerald A. Michalsky
(74) *Attorney, Agent, or Firm*—Morris N. Reinisch; Howrey Simon Arnold & White

(57) ABSTRACT

A method of reducing the viscosity of a heavy oil flowing through a pipe is disclosed. The method includes mixing heavy oil, water and an effective amount of $C_1$ to $C_{10}$ alcohol so as to reduce the viscosity by at least 20% that of the heavy oil. The amount of water present in the heavy oil should be less than about 50% vol. and preferably from about 1% vol. to about 10% vol. The alcohol preferably should be a primary linear alcohol and more preferably is a $C_3$ to $C_7$ primary linear alcohol which may be selected from 1-propanol, 1-butanol, 1-pentanol, 1-hexanol, 1-heptanol or combinations thereof The concentration of alcohol should be less that 10% by weight of the mixture. The mixture may further include a polymeric drag reducing agent in a concentration from about 1 to about 10,000 ppm.

18 Claims, No Drawings

METHOD FOR REDUCING THE PIPELINE DRAG OF HEAVY OIL AND COMPOSITIONS USEFUL THEREIN

FIELD OF THE INVENTION

The present invention is generally directed to a method of reducing the pipeline drag of heavy oil during pipeline transport and the compositions useful therein.

BACKGROUND

Heavy oils, such as Californian Kern River crude oil, Venezuelan Hamaca crude oil or other heavy oils, are typically dense (i.e. API gravity below about 25) and have a high viscosity (i.e. a SUS at 100° F. greater than 1000) Because of these properties, transportation of heavy oil from the well head to the refinery by pipeline is more difficult and expensive than transporting lighter crude oils. The same is true for the pipeline transportation and pumping of other viscous hydrocarbons generated during the refining process such as atmospheric residuals, vacuum flash drum bottoms, bitumen, deasphalter bottoms, tars, etc. The transportation of heavy oil and other heavy hydrocarbons by pipeline requires that the viscosity be low enough so that the size of the pipeline and the pumping requirements are economically optimum.

There are several methods known to one of skill in the art by which heavy oil and heavy hydrocarbons, (hereafter collectively referred to as heavy oil) may be transported by pipeline. These methods include: heating; dilution; oil/water emulsion formation; core annular flow; and partial field upgrading. Each method, however, has its own strengths and weaknesses as discussed below.

Heating is a common method utilized to overcome the above noted problems of transporting heavy oil by pipeline. The basis for this method lies in the fact that as heavy oil is heated the viscosity of the heavy oil is reduced and thus made easier to pump. Thus it is important to heat the oil to a point where the oil has a substantially reduced viscosity. Typically that temperature may be greater than 100° F. (38° C.) and typically may be 200° F. (93° C.) or more depending upon the properties of the heavy oil. In order to retain the heat imparted to the heavy oil, thus maintaining the ability to pump the heavy oil, insulated pipelines are utilized to minimize heat loss. In addition, periodic heating stations, in addition the pump stations may be utilized. A principle draw back to the use of heated pipelines is the high capital and operational cost of operating such a heated pipeline over long distances. In addition, underwater pipeline transportation of heavy oil through a heated pipeline is very difficult due to the cooling effect of the surrounding water and the practical difficulty of maintaining pumping stations and heating stations.

An alternative to heating is dilution of the heavy oil with a less viscous hydrocarbon such as condensate, natural gasoline or naphtha. This method is based on the principle that the addition of from about 10% vol. to about 50% volume of the less viscous hydrocarbons reduces the viscosity of the heavy oil by dilution, thus making pipeline transportation possible. However, the use of this method on a large scale can be cost prohibitive due to the need for mixing and separating stations at each end of the pipeline as well as a return pipeline so that less viscous hydrocarbon, once separated from the heavy oil at the destination, can be reutilized in the transportation of heavy oil. further the use of a diluent reduces the capacity of the pipeline to transport heavy oil.

Another method utilized in the transportation of heavy oil is the formation of the heavy oil into an oil-in-water emulsion. In such a method the heavy oil is suspended as micro-spheres of oil stabilized in a water continuous phase by the use of surfactants and detergents thus achieving a reduction in the apparent viscosity. One of skill in the art should understand that as the water content of the heavy oil/water emulsion increases, the viscosity decreases exponentially. The principle difficulty with the use of this technology is the selection and cost of the surfactant component of the emulsion. Not only must the surfactant be capable of stabilizing the emulsion during transportation, but it also must be capable of separation once the destination point of the pipeline is reached. Further complicating the situation is that often large volumes of water (i.e. greater than about 50%) are needed to reduce the viscosity to suitable levels. Thus the total possible capacity of the pipeline is not used in the transportation of oil thereby impacting the economics of the operation of the pipeline. Illustrative descriptions of the above described oil-in-water emulsions systems may be found for example in U.S. Pat. Nos. 4,190,069; 4,993,448, 4,857,621 and 5,021,526.

Transportation of the oil using core annular flow is another proposed concept. Here an artificially created film of water surrounds the oil core concentrically. This reduces the viscosity and pressure drop almost to that which would be expected for water. These processes require that, where field emulsions are produced, these emulsions be broken first. Water, and in the case of emulsion transport, surfactants, are then added and mixed under controlled conditions to obtain a stable emulsion or core flow. Thus, the water functions as a lubricating layer between the outer annulus of the inner wall of the pipeline and the inner core of heavy oil that is being transported. There exist several difficulties with the use of annular-core flow including an easily upset flow stability, the start-up and shut down process is difficult and the pressure drop may not be sufficient to transport some heavy oils. Further as in all cases where diluents or water are used, a significant part of the capacity of the pipeline is being taken up by a non-heavy oil component, significantly adding to the cost of the system. In the case of water, it might also create a disposal problem at the receiving end of the pipeline. An illustrative description of the above described method may be found for example in U.S. Pat. No. 4,753,261.

Yet another method of reducing the viscosity of heavy oil, thus enabling it to be transported by pipeline, is partial upgrading at the well head. The goal of partial upgrading is to reduce the viscosity and increase the API gravity of the heavy oil prior to transportation. Often this is accomplished by thermal treatment with or without a catalyst in the field in moderately scaled reactors. The primary concern with such an operation is the high capital and operating costs of providing facilities in the field and the safe operation of the upgrading unit at the well site.

When pipeline transporting less viscous oils, commercial drag reduction agents may be used to reduce the pipeline/oil drag. Such agents may provide pressure drop reductions of 15–25%. One of skill in the art should appreciate that such drops in drag reduction have a significant impact on the cost of transporting the oil by pipeline. Unfortunately, commercial drag reducing agents are reported as not showing the same effect when pipeline transporting heavy oils such as Kern River or Hamaca heavy oils. One of skill in the art should also appreciate that commercial drag reducers are degraded by shearing forces in the pipeline. Therefore, commercial drag reducers are typically reinjected after each pump station in order maximize their beneficial effect.

In view of the above, there exists a continuing need for methods which reduce the pipeline drag of heavy oil.

SUMMARY OF THE INVENTION

The present invention is generally directed to a method of reducing the viscosity of a heavy oil flowing through a pipe. The method includes mixing heavy oil, water and an effective amount of $C_1$ to $C_{10}$ alcohol so as to reduce the viscosity by at least 20% that of the heavy oil. The heavy oil may be oil that has been dewatered at the well head and subsequently mixed with water or it may be heavy oil which has not been dewatered, or it may be heavy hydrocarbon such as those previously disclosed above or it may be mixtures of these. The amount of water present in the heavy oil should be less than about 50% vol. and preferably from about 1% vol. to about 10% vol. The method may further include pumping the mixture of heavy oil, water and $C_1$ to $C_{10}$ alcohol from one point along the pipe to another second point along the pipe. The alcohol preferably should be a primary linear alcohol. In one embodiment the alcohol is a $C_3$ to $C_7$ primary linear alcohol which may be selected from 1-propanol, 1-butanol, 1-pentanol, 1-hexanol, 1-heptanol or combinations thereof The concentration of alcohol should be less that 10% by weight of the mixture. Because of the volatility of the alcohol, it is desirable that the temperature of the pipeline be maintained at a temperature less than about 160° F. The mixture may further include a polymeric drag reducing agent in a concentration from about 1 to about 10,000 ppm.

The present invention also encompasses a method of transporting a heavy oil by way of a pipeline, and a method of increasing the flow of heavy oil through a pipeline. The first method includes mixing heavy oil, water and a $C_1$ to $C_{10}$ alcohol to form an mixture, the mixture having a viscosity at least 20% lower than the heavy crude and pumping the mixture through the pipeline from a first point to a second point along the pipeline. The second method includes: mixing the heavy oil, water and a $C_1$ to $C_{10}$ alcohol to form an mixture, the mixture having at least double the flow rate at constant pressure drop than that of the heavy crude and pumping the mixture through the pipeline from a first point to a second point along the pipeline. In either method the heavy oil may be oil that has been dewatered at the well head and subsequently mixed with water or it may be heavy oil which has not been dewatered, or it may be heavy hydrocarbon such as those previously disclosed above or it may be mixtures of these. The amount of water present in the heavy oil should be less than about 50% vol. and preferably from about 1% vol. to about 10% vol. The alcohol may be a $C_3$ to $C_7$ primary linear alcohol and preferably the alcohol may be selected from 1-propanol, 1-butanol, 1-pentanol, 1-hexanol, 1-heptanol or combinations thereof. The concentration of alcohol should be sufficient to achieve the above noted results of reduction in viscosity or flow rate respectively and preferably is less that 10% by weight of the mixture.

Further the present invention also includes the compositions that are useful in the methods disclosed herein.

DESCRIPTION OF ILLUSTRATIVE EMBODIMENTS

It has been unexpectedly and surprisingly discovered that the addition of alcohols significantly reduces the viscosity and thus the pipeline drag of heavy oils. Not only has an effective drag reduction method been unexpectedly discovered, it has been found that a significant (by a factor of 2–4) and surprising pressure drop reduction is realized by the addition of alcohols in accordance with the present invention.

The above statements have been based on the unexpected and surprising results of experiments involving an exemplary heavy oil, Kern River heavy oil which has a density of 0.972 g/ml, an API gravity of 13.0°, and a viscosity of 10,000 centipoise at 72° F. The present invention may be practiced using produced heavy oil that has not been dewatered or may be practiced using heavy oil into which water is added or it may be a heavy hydrocarbon such as those previously disclosed above or it may be mixtures of these. The amount of water present in the heavy oil should be less than about 50% vol. and preferably from about 1% vol. to about 10% vol.

A sample of produced Kern River heavy oil was mixed with the alcohol indicated in the volume shown. The viscosity of each sample was measured and with representative results being presented in Table 1 below.

TABLE I

| Additive | 0 wt % | 1 wt % | 3 wt % | 5 wt % |
|---|---|---|---|---|
| | 14/24 Viscosity (cP at 35° C.) | | | |
| methanol | 3090 (1.00)* | 2295 (0.74)* | 1934 (0.63)* | 1836 (0.59)* |
| ethanol | 3090 (1.00)* | 2030 (0.66)* | 1534 (0.49)* | 1509 (0.48)* |
| 1-propanol | 3090 (1.00)* | 1802 (0.58)* | 1411 (0.45)* | 966 (0.31)* |
| 1-butanol | 3090 (1.00)* | 2037 (0.66)* | 1010 (0.32)* | 894 (0.29)* |
| 1-pentanol | 3090 (1.00)* | 2600 (0.84)* | 1280 (0.41)* | 882 (0.28)* |
| 1-octanol | 3090 (1.00)* | 2500 (0.80)* | 1560 (0.50)* | 1080 (0.35)* |

*Relative viscosity value = viscosity w/alcohol ÷ viscosity w/o alcohol

In view of Table I, a person of ordinary skill in the art should recognize that the addition of about 1 to about 5 weight % of an alcohol can reduce the viscosity of Kern River heavy oil at 35° C. Table I further illustrates that not only do alcohols reduce the viscosity of Kern River heavy oil, but the effect is not due to simple dilution, since different alcohols reduce the viscosity by different amounts when present at the same concentration. Based on this latter observation, a person of skill in the art should notice there is an alcohol type-concentration effect. That is to say 1-butanol has a larger effect (i.e. a greater reduction in effective viscosity) at about 3 wt. % than 1-pentanol. Likewise, about 5% weight 1-pentanol reduces the effective viscosity to a greater extent than about 5% weight 1-butanol. Upon review of the data presented in Table I, a person of ordinary skill in the art should conclude that there exists an optimum carbon chain length of 4 to 5 carbons for the linear primary alcohols and a secondary conclusion should be that butanol and pentanol are most effective at reducing the effective viscosity of heavy oil.

It has been observed that the above noted effect of alcohols on the viscosity of heavy oil is not just confined to Kern River heavy oil. Table II below presents data in support of a conclusion that the effect is observed on other heavy oils including: Heimdal, a heavy oil from the North Sea; Perry Miss heavy oil, from Louisiana; and BCF-13, from Venezuela.

TABLE II

| | Weight % 1 - Pentanol | |
|---|---|---|
| | 0% | 5% |
| | Viscosity (cP at 35° C.) | |
| Kern River | 3090 (1.00)* | 882 (0.29)* |
| Heimdal | 3820 (1.00)* | 1223 (0.32)* |
| Perry Miss | 3563 (1.00)* | 1764 (0.49)* |
| BCF-13 | 4733 (1.00)* | 1300 (0.27)* |

*Relative viscosity value = viscosity w/alcohol ÷ viscosity w/o alcohol

Upon review of the above data in Table II, one of skill in the art should recognize that the addition of 1-pentanol reduces the effective viscosity of a variety of different types of heavy oil. Further upon review of the relative viscosity values, one should recognize that the 1-pentanol is capable of reducing the viscosity of the heavy oil by at least 20% (i.e. to a value of relative viscosity lower than 0.80) and in some cases the viscosity is reduced by greater than 50% (i.e. to a value of relative viscosity lower than 0.50).

It has further been observed that not only may the viscosity reduction of the present invention depend upon the number of carbon atoms in the hydrocarbon portion of the alcohol, but the viscosity reduction of the present invention appears to depend upon the position of the alcohol functional group (—OH) along the hydrocarbon chain. Data in support of this conclusion is given below in Table III.

TABLE III

| | Weight % Alcohol | | | |
|---|---|---|---|---|
| | 0% | 1% | 3% | 5% |
| | Viscosity (cP at 45 0C) | | | |
| 1-pentanol | 1140 | 825 | 554 | 402 |
| 2-pentanol | 1140 | 902 | 771 | 460 |
| 3-pentanol | 1140 | 925 | 622 | 518 |

Upon review of the above data, one of skill in the art should recognize that the data in Table III indicates that 1-pentanol has a greater effect in reducing viscosity of Kern River heavy oil than does 2-pentanol. Likewise, 2-pentanol appears to have a greater effect in reducing viscosity in Kern River heavy oil than does 3-pentanol. Thus one of skill in the art should conclude that linear alcohols should be preferred to secondary alcohols and secondary alcohols should be preferred to tertiary alcohols in reducing the viscosity of Kern River heavy oil. In view of the above trend, one embodiment of the present invention preferably utilizes primary linear alcohols to achieve the unexpected and surprising results disclosed herein. However, one of skill in the art would understand that the above trend may be different with other heavy oils and determination of the optimum alcohol can be determined by conducting a study of different alcohols as was done above to optimize the reduction in viscosity.

It has further been discovered that the viscosity can be further reduced by combining an alcohol with a conventional drag reduction agent such as LPCRD available from CONOCO. To a mixture of Heimdal heavy oil, containing about 5% water, and 1-pentanol, varying amounts of LPCRD were added and the viscosity was measured at two different temperatures. Exemplary results of this experiment are given in Table IV below.

TABLE IV

| Viscosity of Heimdal Heavy oil with 5% 1-Pentanol | | |
|---|---|---|
| Conc. LPCRD (ppm) | cP at 35° C. | cP at 45° C. |
| 0 | 1223 | 516 |
| 100 | 985 | 422 |
| 500 | 911 | 420 |
| 1000 | 1135 | 442 |

Upon review of the above data, one of skill in the art should conclude that the optimum amount of drag reducer LPCRD lies between about 100 ppm and 1000 ppm. Routine testing in which the concentration of drag reducing agent is incrementally increased would optimize this effect.

It has been found that the above noted increased reduction in viscosity depends on the heavy oil and the concentration of alcohol. Table V below present exemplary data for the viscosity of a mixture of Kern River heavy oil, 1-pentanol, water and LPCRD.

TABLE V

| % LPCRD | 5% 1-Pentanol | 3% 1-Pentanol | 1% 1-Pentanol |
|---|---|---|---|
| | Viscosity (cP at 45° C.) | | |
| 0 | 402 | 554 | 825 |
| 0.1 | 361 | 544 | 918 |
| 0.3 | 374 | 544 | 868 |
| 0.5 | 407 | 508 | 838 |
| 1 | 416 | 551 | 962 |
| 1.5 | 1440 | 571 | 972 |

Upon review of the above data, one of ordinary skill in the art should note that the viscosity of mixture of 5% pentanol in Heimdal heavy oil exhibited maximum reduction when the LPCRD had a concentration of about 500 ppm. In contrast, the viscosity is at a minimum when the LPCRD is 1000 ppm for 5% pentanol in Kern River. Thus one of skill in the art should understand that the type of heavy oil involved may have an effect on the amount and effect of the additional reduction in viscosity due to the addition of drag reducing agents.

Unlike the prior art drag reducing chemicals, such as polymers, and the like, the drag reduction of this invention is not believed to be degraded by shear forces caused by pumps and friction with the pipeline walls. One of skill in the art should appreciate that this means that extra injections of drag reducing agent are not required. This allows the pipeline operator to eliminate the additional maintenance and cost of operating periodic drag reducing agent points along the length of the pipeline.

In view of the above disclosure, one illustrative embodiment of the present invention is a method of reducing the viscosity of a heavy oil flowing through a pipe. The method includes mixing heavy oil, water and an effective amount of $C_1$ to $C_{10}$ alcohol so as to reduce the viscosity by at least 20% that of the heavy oil. The heavy oil may be oil that has been dewatered at the well head and subsequently mixed with water or it may be heavy oil which has not been dewatered, or it may be heavy hydrocarbon such as those previously disclosed above or it may be mixtures of these. The method may further include pumping the mixture of heavy oil, water and $C_1$ to $C_{10}$ alcohol from one point along the pipe to another second point along the pipe. The amount of water present in the heavy oil should be less than about 50% vol. and preferably from about 1% vol. to about 10% vol. The alcohol preferably should be a primary linear alcohol. In one embodiment the alcohol is a $C_3$ to $C_7$ primary linear alcohol which may be selected from 1-propanol, 1-butanol, 1-pentanol, 1-hexanol, 1-heptanol or combinations thereof The concentration of alcohol should be less that 10% by weight of the mixture. Because of the volatility of the alcohol, it is desirable that the temperature of the pipeline be maintained at a temperature less than about 160° F. The mixture may further include a polymeric drag reducing agent in a concentration from about 1 to about 10,000 ppm.

Another illustrative embodiment of the present invention is a method of transporting a heavy oil by way of a pipeline. Such an illustrative embodiment includes: mixing the heavy oil with water and a $C_1$ to $C_{10}$ alcohol to form an mixture, the mixture having a viscosity at least 20% lower than the heavy crude; and, pumping the mixture through the pipeline from a first point to a second point along the pipeline. The heavy oil may be oil that has been dewatered at the well head and subsequently mixed with water or it may be heavy oil which has not been dewatered, or it may be heavy hydrocarbon such as those previously disclosed above or it may be mixtures of these. The amount of water present in the heavy oil should be less than about 50% vol. and preferably from about 1% vol. to about 10% vol. The mixture formed in the practice of the present illustrative embodiment may include an alcohol that may preferably be a primary linear alcohol and more preferably may be a $C_3$ to $C_7$ primary linear alcohol. Such an alcohol may be selected from 1-propanol, 1-butanol, 1-pentanol, 1-hexanol, 1-heptanol or combinations thereof. In another embodiment of the composition made in accordance with the present illustrative embodiment, the concentration of alcohol is sufficient to achieve the decrease in viscosity noted above. The alcohol may also preferably be less that 10% by weight of the mixture. Optionally the composition of the present illustrative embodiment may include a polymeric drag reducing agent in a concentration from about 1 to about 10,000 ppm. The illustrative method may further comprise maintaining the temperature of the pipeline at a temperature less than about 160° F.

Yet another illustrative embodiment of the present invention is a method of increasing the flow of heavy oil through a pipeline. Such a method includes: mixing heavy oil with water and a $C_1$ to $C_{10}$ alcohol to form a mixture, and pumping the mixture through the pipeline from a first point to a second point along the pipeline. The heavy oil may be oil that has been dewatered at the well head and subsequently mixed with water or it may be heavy oil which has not been dewatered, or it may be heavy hydrocarbon such as those previously disclosed above or it may be mixtures of these. The mixture of the present illustrative embodiment exhibits at least twice the flow rate at constant pressure drop than that of the heavy crude. The amount of water present in the heavy oil should be less than about 50% vol. and preferably from about 1% vol. to about 10% vol. The mixture formed in the practice of the present illustrative embodiment may include an alcohol that may preferably be a primary linear alcohol and more preferably may be a $C_3$ to $C_7$ primary linear alcohol. Such an alcohol may be selected from 1-propanol, 1-butanol, 1-pentanol, 1-hexanol, 1-heptanol or combinations thereof In another embodiment of the composition made in accordance with the present illustrative embodiment, the concentration of alcohol is sufficient to achieve the increase in flow rate noted above. The alcohol may also preferably be less that 10% by weight of the mixture. Optionally the composition of the present illustrative embodiment may include a polymeric drag reducing agent in a concentration from about 1 to about 10,000 ppm. The illustrative method may further include maintaining the temperature of the pipeline at a temperature less than about 160° F.

Also encompassed with the scope of the present invention are the compositions useful in the above described methods. Thus one illustrative composition within the scope of the present invention is a composition useful in the transportation of a heavy oil through a pipeline. Such a composition may include: heavy oil, water and a $C_1$ to $C_{10}$ primary linear alcohol such that the composition has at least double the flow rate measured at a constant pressure drop when compared to the heavy oil. The heavy oil may be oil that has been dewatered at the well head and subsequently mixed with water or it may be heavy oil which has not been dewatered, or it may be heavy hydrocarbon such as those previously disclosed above or it may be mixtures of these. The amount of water present in the heavy oil should be less than about 50% vol. and preferably from about 1% vol. to about 10% vol. The alcohol in may be a $C_3$ to $C_7$ primary linear alcohol or the alcohol may be selected from 1-propanol, 1-butanol, 1-pentanol, 1-hexanol, 1-heptanol or combinations thereof. In one embodiment of the composition, the concentration of alcohol is sufficient to achieve the increase in flow rate at constant pressure drop noted above. The alcohol may also preferably be less that 10% by weight of the mixture. The composition of the present illustrative embodiment may optionally include a polymeric drag reducing agent in a concentration from about 1 to about 10,000 ppm. In addition to the increased flow rate, the composition may exhibit an effective viscosity that is at least 20% lower than the heavy oil alone and may further exhibit an effective viscosity that is at least 50% lower than the heavy oil. Further, the composition of the present illustrative embodiment may exhibit an effective viscosity at 35° C. that is at least 500 centipoise lower than the heavy oil and may further exhibit an effective viscosity at 35° C. that is at least 1000 centipoise lower than the heavy oil.

Another illustrative composition with the scope of the present invention is a composition useful in the transportation of a heavy oil through a pipeline. The present illustrative composition includes: heavy oil; water; and a $C_3$ to $C_7$ primary linear alcohol selected from 1-propanol, 1-butanol, 1-pentanol, 1-hexanol, 1-heptanol or combinations thereof. The heavy oil may be oil that has been dewatered at the well head and subsequently mixed with water or it may be heavy oil which has not been dewatered, or it may be heavy hydrocarbon such as those previously disclosed above or it may be mixtures of these. The amount of water present in the heavy oil should be less than about 50% vol. and preferably from about 1% vol. to about 10% vol. The present illustrative composition may have an effective viscosity that is reduced by least 20% when compared to the heavy oil. Such a composition may exhibit an effective viscosity at 35° C. that is at least 500 centipoise lower than the heavy oil and may further exhibit an effective viscosity that is at least 1000 centipoise lower than the heavy oil. In one embodiment of the composition, the concentration of alcohol is sufficient to achieve the increase in flow rate at constant pressure drop noted above. The alcohol may also preferably be less that 10% by weight of the mixture. The composition of the present illustrative embodiment may optionally include a polymeric drag reducing agent in a concentration from about 1 to about 10,000 ppm.

The following examples are included to demonstrate preferred embodiments of the invention. It should be appreciated by those of skill in the art that the techniques disclosed in the examples which follow represent techniques discovered by the inventors to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit and scope of the invention.

EXAMPLE 1

The effect of alcohol on the flow characteristics of viscous heavy oils under pipeline conditions was evaluated in a 1¼ circulating oil flowloop. The loop consisted of a 120 gal. storage tank, a pulse-less progressive cavity Moyno pump with maximum discharge pressure of 200 psi, a frame and plate heat exchanger, and a 120 foot loop of 1¼ Schedule 40 pipe from the storage tank, through the pump, through the test section of the loop, and back to the tank. The test section of the flowloop was 86 feet long. A Rosemount differential pressure transducer was used to measure the difference between inlet and outlet pressures in the test section of the loop. The tank and pipe were insulated, and the skins temperatures were controlled in order to maintain isothermal conditions during the test period. Operation of the unit was controlled with a microcomputer. In a typical test an oil temperature and flowrate was chosen, the oil was allowed to circulate through the loop for two-four hours in order to establish steady state conditions, and then the differential pressure drop across the test section of the loop was measured. The test utilized Kern River heavy oil that contained about 2% vol. water. Table VI below presents illustrative results from this test.

TABLE VI

| Pressure Drop Across 86 Foot Section of 1¼" Pipe (psi/ft) | | |
|---|---|---|
| | % 1-Pentanol in Kern River Heavy oil | |
| Flowrate (gpm) | 0% | 10% |
| 0.3 | 0.13 | 0.03 |
| 0.5 | 0.21 | 0.05 |
| 0.7 | 0.27 | 0.07 |
| 1 | 0.37 | 0.08 |
| 1.3 | — | 0.1 |
| 1.5 | — | 0.11 |
| 1.7 | — | 0.12 |
| 2 | — | 0.14 |
| 2.5 | — | 0.17 |
| 3 | — | 0.24 |

Table VI illustrates the effect of 10% pentanol on the pressure drop across the test section with Kern River heavy oil at about 87° F. The values of pressure drop are reported in psi/ft and the flowrate in gallons per minute (gpm). Upon review of the above data, one of ordinary skill in the art should realize that not only is the pressure drop across the test section reduced significantly when 1-pentanol is present, but the flowrate at an equivalent pressure drop is increased by a factor of 3–4. It should be noted that pressure drops could not be measured with Kern River heavy oil for flowrates above 1 gpm because the pump discharge pressure exceeded the maximum discharge pressure rating for this pump.

EXAMPLE 2

The procedure described above in Example 1 was carried out utilizing 1-butanol as the alcohol in the place of 1-propanol. Table VII below presents exemplary results.

TABLE VII

| Pressure Drop Across 86 Foot Section of 1¼" Pipe (psi/ft) | | |
|---|---|---|
| | % 1-Butanol in Kern River Heavy oil | |
| Flowrate (gpm) | 0% | 5% |
| 0.3 | 0.15 | |
| 0.5 | 0.23 | 0.08 |
| 0.7 | 0.3 | 0.1 |
| 1 | 0.38 | 0.14 |
| 1.3 | — | 0.16 |
| 1.5 | — | 0.19 |
| 1.7 | — | 0.2 |
| 2 | — | 0.23 |
| 2.5 | — | 0.26 |
| 3 | — | 0.38 |

Table VII shows the effect of 5% 1-butanol in a mixture of Kern River heavy oil at a temperature of about 94° F. Upon review of the data in Table VII, one of skill in the art should recognize that 5% 1-butanol reduces the pressure drop at an equivalent flowrate by a factor of approximately 3, and allows the capacity of the line to increase at an equivalent pressure drop by a factor of three.

EXAMPLE 3

The tests described above in Example 1 were repeated utilizing a mixture of Kern River heavy crude containing about 2% water, 5% pentanol and 0.1% of LPCRD Table VII below presents exemplary data from the test conducted at a temperature of about 97° F.

TABLE VIII

| Pressure Drop Across 86 Foot Section of 1¼" Pipe (psi/ft) | | |
|---|---|---|
| | % Pentanol +0.1% LPCRD in Kern River Heavy oil | |
| Flowrate (gpm) | 0% | 5% |
| 0.3 | 0.12 | — |
| 0.5 | 0.17 | — |
| 0.7 | 0.24 | — |
| 1 | 0.34 | 0.15 |
| 2 | — | 0.27 |
| 3 | — | 0.38 |

Upon review of the above data one of skill in the art should recognize that again there is a significant reduction in pressure drop for equivalent flowrates, and the maximum flowrate achievable with this pump is increased by a factor of about three.

EXAMPLE 4

The tests described above in Example 1 were repeated utilizing a mixture of BCF-13 heavy crude that contained about 5% wt water, 5% pentanol and 100 ppm of LPCRD Table IX below presents exemplary data from the test conducted at a temperature of about97° F.

TABLE IX

| Pressure Drop Across 86 Foot Section of 1¼" Pipe | | |
|---|---|---|
| | % 1-Pentanol +0.1% LPCRD in BCF-13 Heavy oil | |
| Flowrate (gpm) | 0% | 5% |
| 0.3 | 0.19 | 0.05 |
| 0.5 | 0.27 | 0.08 |
| 0.7 | 0.36 | 0.11 |
| 1 | — | 0.17 |
| 1.3 | — | 0.21 |
| 1.5 | — | 0.24 |
| 1.7 | — | 0.26 |
| 2 | 0.3 | |

Upon review of the above data one of skill in the art should conclude that the mixture made according to the present invention exhibits a flow rate that is at lease twice that of the heavy oil absent the alcohol component. It will also be noted that flowrates greater than 0.7 gpm could not be achieved with the unaltered heavy oil due to the limitation on the pump discharge pressure.

EXAMPLE 5

The tests described above in Example 1 were repeated utilizing a mixture of Kern River heavy crude oil that contained about 2% wt water. Table X below presents exemplary data from the test conducted at a temperature of about 97° F. for untreated heavy crude oil, heavy crude oil mixed with the drag reducer LPCDR, and heavy crude oil mixed with both 1-pentanol and LPCDR.

TABLE X

| Pressure Drop Across 86 Foot Section of 1¼" Pipe | | | |
|---|---|---|---|
| Flowrate (gal./min.) | Untreated (psi/ft) | 1000 ppm LPCDR (psi/ft) | 5% 1-Pentanol + 1000 ppm LPCDR (psi/ft) |
| 0.3 | 0.071 | 0.109 | 0.044 |
| 0.5 | 0.114 | 0.167 | 0.070 |
| 0.7 | 0.151 | 0.227 | 0.092 |
| 1.0 | 0.205 | 0.360 | 0.127 |
| 1.3 | 0.294 | 0.360 | 0.162 |

Upon review of the above data, one of skill in the art should understand and appreciate that the addition of 1000 ppm of a conventional drag reducing agent (LPCDR) is not effective in reducing the pressure drop and actually causes an increase in the pressure drop. Such a result is in contradiction to the desired effect. In contrast, when a combination both LPCDR and 1-pentanol are added to the heavy crude oil, the pressure drop is reduced by more than 35%.

While the compositions and methods of this invention have been described in terms of preferred embodiments, it will be apparent to those of skill in the art that variations may be applied to the process described herein without departing from the concept, and scope of the invention. All such similar substitutes and modifications apparent to those skilled in the art are deemed to be within the scope and concept of the invention.

What is claimed is:

1. A method of reducing the viscosity of a heavy oil flowing through a pipe, the method comprising:

forming a mixture consisting essentially of heavy oil, water and an effective amount of $C_1$ to $C_{10}$ alcohol so as to reduce the viscosity by at least 20% that of the heavy oil.

2. The method of claim 1 wherein the alcohol is a primary linear alcohol.

3. The method of claim 1 wherein the alcohol is a $C_3$ to $C_7$ primary linear alcohol.

4. The method of claim 1 wherein the alcohol is a selected from 1-propanol, 1-butanol, 1-pentanol, 1-hexanol, 1-heptanol or combinations thereof.

5. The method of claim 1 wherein the concentration of alcohol is less that 10% by weight of the mixture.

6. The method of claim 1 wherein the temperature of the pipeline is maintained at a temperature less than about 160° F.

7. The method of claim 1 wherein the mixture further consists essentially of a polymeric drag reducing agent in a concentration from about 1 to about 10,000 ppm.

8. A method of transporting a heavy oil by way of a pipeline, the method comprising forming a mixture consisting essentially of heavy oil, water and a $C_1$ to $C_{10}$ alcohol, the mixture having a viscosity at least 20% lower Than the heavy crude and pumping the mixture through the pipeline from a first point to a second point along the pipeline.

9. The method of claim 8 wherein the alcohol is a primary linear alcohol.

10. The method of claim 8 wherein the alcohol is a $C_3$ to $C_7$ primary linear alcohol.

11. The method of claim 8 wherein the alcohol is a selected from 1-propanol, 1-butanol, 1-pentanol, 1-hexanol, 1-heptanol or combinations thereof.

12. The method of claim 8 wherein the concentration of alcohol is less that 10% by weight of the mixture.

13. The method of claim 8 wherein the temperature of the pipeline is maintained at a temperature less than about 160° F.

14. The method of claim 8 wherein the mixture further consists essentially of a polymeric drag reducing agent in a concentration from about 1 to about 10,000 ppm.

15. A method of increasing the flow of heavy oil through a pipeline, the method comprising:

forming a mixture consisting essentially of heavy oil, water and a $C_1$ to $C_{10}$ alcohol, the mixture having at least double the flow rate at constant pressure drop than that of the heavy crude and pumping the mixture through the pipeline from a first point to a second point along the pipeline.

16. The method of claim 15 wherein the alcohol is a $C_3$ to $C_7$ primary linear alcohol.

17. The method of claim 16 wherein the alcohol is a selected from 1-propanol, 1-butanol, 1-pentanol, 1-hexanol, 1-heptanol or combinations thereof.

18. The method of claim 17 wherein the concentration of alcohol is less that 10% by weight of the mixture.

* * * * *

UNITED STATES PATENT AND TRADEMARK OFFICE

CERTIFICATE OF CORRECTION

PATENT NO. : 6,178,980

DATED : January 30, 2001

INVENTOR(S) : David A. Storm

It is certified that error appears in the above-identified patent and that said Letters Patent is hereby corrected as shown below:

In Column 4, line 25, delete "14/24";

In Column 11, line 14, under the 0% column, delete "0.3" and under the 5% column insert – 0.3 –

Signed and Sealed this

Fifteenth Day of May, 2001

*Attest:*

Nicholas P. Godici

NICHOLAS P. GODICI

*Attesting Officer*

*Acting Director of the United States Patent and Trademark Office*